US008674853B2

(12) United States Patent
Gorabi et al.

(10) Patent No.: US 8,674,853 B2
(45) Date of Patent: Mar. 18, 2014

(54) SYSTEM AND METHOD FOR AUTOMATIC DISTRESS AT SEA

(76) Inventors: Mohammad Mahdavi Gorabi, Tehran (IR); Reza Hossein Ghobakhloo, Tehran (IR); Ebrahim Aminizadeh, Tehran (IR)

( * ) Notice: Subject to any disclaimer, the term of this patent is extended or adjusted under 35 U.S.C. 154(b) by 309 days.

(21) Appl. No.: 13/236,668

(22) Filed: Sep. 20, 2011

(65) Prior Publication Data

US 2012/0007750 A1 Jan. 12, 2012

(51) Int. Cl.
*G08B 23/00* (2006.01)

(52) U.S. Cl.
USPC ..... 340/984; 340/539.18; 340/6.1; 340/7.5; 340/8.1

(58) Field of Classification Search
USPC ..... 340/984, 573.1, 539.13, 8.1, 7.5, 6.1, 340/539.16–539.18
See application file for complete search history.

(56) References Cited

U.S. PATENT DOCUMENTS

| | | | | |
|---|---|---|---|---|
| 2009/0271054 | A1* | 10/2009 | Dokken | 701/21 |
| 2010/0271198 | A1* | 10/2010 | Boling et al. | 340/539.1 |
| 2011/0095914 | A1* | 4/2011 | Velado et al. | 340/984 |
| 2011/0133987 | A1* | 6/2011 | Bernsten et al. | 342/417 |
| 2011/0144912 | A1* | 6/2011 | Lee et al. | 701/301 |
| 2011/0215948 | A1* | 9/2011 | Borgerson et al. | 340/989 |
| 2012/0053472 | A1* | 3/2012 | Tran | 600/509 |

OTHER PUBLICATIONS

Ilcev, S.D., "Satellite CNS for maritime transportation augmentation system (MTAS)," Microwave & Telecommunication Technology, 2009. CriMiCo 2009. 19th International Crimean Conference , vol., No., pp. 3,8, Sep. 14-18, 2009 URL: http://ieeexplore.ieee.org/stamp/stamp.jsp?tp=&arnumber=5293250&isnumber=5292809.*
"Electronic Charts", IMO.org, http://www.imo.org/OurWork/Safety/Navigation/Pages/ElectronicCharts.aspx.*
"Kannad Marine EPIRB User Manual", 82-810-005 Issue 1.*
Archive.org: "Kannad Marine EPIRB User Manual", 82-810-005 Issue 1.*

* cited by examiner

*Primary Examiner* — Brian Zimmerman
*Assistant Examiner* — Laura Nguyen
(74) *Attorney, Agent, or Firm* — Barry Choobin; Patent 360 LLC

(57) ABSTRACT

The embodiments herein provide a system and a method for automatic distress alerting at sea. The method comprises detecting a distress situation by the sensors, sending a distress signal to the processor device, initiating an alarm for a predefined time, confirming the detected distress situation by a responsible officer, sending a distress alert package generated by the processor device through a main transmitter device to several satellites and to the terrestrial stations, informing nearest maritime search and rescue coordination centers after receiving the distress alert package and sending one or more rescue teams to a location based on a data provided in the distress alert package. If the alarm is detected to be false by the responsible officer then the distress alert is removed and alarm is activated if the responsible officer neither confirms nor denies the distress situation.

10 Claims, 5 Drawing Sheets

SYSTEM AND METHOD FOR AUTOMATIC DISTRESS AT SEA

BACKGROUND

1. Technical Field

The embodiments herein generally relates to distress alert messaging system and methods. The embodiments herein particularly relate to an automatic distress alerting at sea. The embodiments herein more particularly relates to an improved system and method for automatic distress alerting at sea by removing the pivotal human role in receiving, recording and sending the distress alert data to reduce false distress alert messages.

2. Description of the Related Art

Global Maritime Distress Safety System (GMDSS) is one of the systems for emergency reporting at sea and so far this communication system has helped to rescue of lives, in marine emergency situations. The systems have been developed to provide mariners with global communications and locating network. The concept of GMDSS arose as an idea by the International Maritime Organization (IMO) in 1973 and entered into force in February 1999. The requirements of ships to comply with GMDSS are prescribed by the Convention for Safety of Life at Sea (SOLAS). This system is applicable to all passenger vessels and all cargo vessels over 300 GT, when they are sailing in international voyages.

In GMDSS system, human is responsible for receiving and detecting distress, recording the mentioned distress and sending the distress data from any of the transmitter device. It is found by the various experiments and observations that almost 70% of the causes of sending false distress alert was related to human role or human error. And in GMDSS system, all of the equipments function separately and independently, and further the large number of these equipments and their various models generate difficulties in the introduction of their performance in sending the data which leads to the creation of false alerts.

The total amount of costs incurred in checking, analyzing and taking actions for rescue operations on search and rescue centers after receiving the distress signals sent from ships is significantly high. It was realized that the most important factor in sending false distress signals was human errors which includes 70 percent of the transmitted false signals. Based on the investigations made on this problem it was found that the most important reason behind the human errors is a lack of skilled personnel knowing how to report the sending of a false distress alert signal. Therefore, there is a need for an automatic distress alert method and system to reduce the role of human factors in sending the distress signals and operating the systems.

The abovementioned shortcomings, disadvantages and problems are addressed herein and which will be understood by reading and studying the following specification.

OBJECT OF THE EMBODIMENTS

The primary object of the embodiments herein is to develop a system for providing an automatic distress alerting at sea.

Another object of the embodiments herein is to provide an automatic distress alerting system and method to reduce the role of human factors in causing the errors.

Yet another object of the embodiments herein is to provide an automatic distress alerting system and method to reduce the role of human factors in causing the errors and to decrease the costs incurred by checking and analyzing the signals and taking actions in rescue operations.

Yet another object of the embodiments herein is to provide an automatic distress alerting system in which all the electronic equipment used in the system, share the data between them.

Yet another object of the embodiments herein is to provide an automatic distress alerting system in which human being will just have a supervisory role over the proper functioning of the system.

Yet another object of the embodiments herein is to provide an automatic distress alerting system in which the human has to confirm the detected calamity after the detection of a distress situation by a sensor.

Yet another object of the embodiments herein is to provide an automatic distress alerting system and method designed according to the International Maritime Organization for preventing distress conditions that threaten the human life at sea including falling in the sea water, fire on the ship, collision or accident and floods.

Yet another object of the embodiments herein is to provide an automatic distress alerting system and method to reduce the generation of false distress alert at sea.

Yet another object of the embodiments herein is to provide an automatic distress alerting system and method to confirm the detection of distress alert and to prevent generation of false alerts due to human error.

These and other objects and advantages of the embodiments herein will become readily apparent from the following detailed description taken in conjunction with the accompanying drawings.

SUMMARY

The various embodiments herein provide a system and method for automatic distress alert messaging at sea. According to an embodiment herein, a method for automatic distress alerting at sea comprises installing a plurality of sensors and processor device on a ship, detecting a distress situation by the plurality of sensors, sending a distress signal to the processor device, initiating an alarm for a pre-defined time by the processor device, confirming the distress situation detected in the ship by a responsible officer, generating a distress alert package by the processor device, sending the distress alert package to a main transmitter device by the processor device, transmitting the distress alert package to one or more satellites in the highest orbit of an earth by the main transmitter device, transmitting the received distress alert package to the terrestrial stations by one or more satellites, informing nearest maritime search and rescue coordination center by the terrestrial stations after receiving the distress alert package and sending one or more rescue teams to a location based on a data provided in the distress alert package. When the alarm is detected to be false and the responsible officer does not confirm the distress situation, the distress alert is removed from a process and when the responsible officer neither confirms nor denies the distress situation for a pre-determined time, a distress alert process is continued automatically and the processor device confirms the distress situation.

According to one embodiment, the plurality of sensors installed on the ship comprises a plurality of fire detection sensors comprising a plurality of heat sensors, a plurality of smoke sensors for detecting fire or smoke on the ship, at least one flooding detection sensor for detecting floods at the sea, a plurality of collision and grounding sensors for detecting a collision of the ship, a man over board sensor installed in a special form of a watch to detect a man over board situation and a sinking vessels sensor with emergency position-indicating radio beacon (EPIRB) for detecting a sinking event of a ship.

According to one embodiment, the generated distress alert package comprises a type of the emergency situation and an event received from the plurality of sensors installed on the ship, a situation of a distressed craft received from a global positioning system, an emergency declaration time received from the global positioning system, an international maritime organization (IMO) number or unique identification number (CALL SIGN) or maritime mobile service identity (MMSI) received from an automatic identification system, a type of a dangerous cargo received from the automatic identification system and a satellite contact number of the distressed craft from one or more satellites.

According to one embodiment, the distress situation is at least one of an event selected from a group of events comprising a fire on a ship, a flooding condition, a falling event from a ship to a sea, a man over board condition, a ship sinking event, a marine accident condition and an aground condition.

According to one embodiment, the method for automatic distress alerting further comprises, confirming and denying a distress situation by the responsible officer in the ship using a confirm button and a deny button provided in the processor device installed on the ship.

According to one embodiment, the main transmitter device is a Search and Rescue Beacon (SAR Beacon) device and the SAR Beacon device sends the distress alert package on a pre-determined frequency and transmits the distress alert package to s pace System for the Search of Vessels in Distress-Search and Rescue Satellite-Aided Tracking (COSPAS-SARSAT satellites) in the highest orbit of the earth.

According to one embodiment, the method for automatic distress alerting further comprises displaying an information from electronic navigational charts (ENC) and an integrated position information from a Global Positioning System (GPS) and a plurality of navigational sensors on an electronic chart display and information system (ECDIS) installed on the ship, and wherein the plurality of navigational sensors include Radar and automatic identification systems (AIS).

According to one embodiment, the method for automatic distress alerting further comprises displaying an alert message transmitted by a transmitter positioned on a distressed craft on an ECDIS map to indicate to the responsible officer that a distress alert package is transmitted from the ship by the transmitter devices.

According to one embodiment, the method for automatic distress alerting further comprises identifying a direction of an alert message transmitted from a distressed ship and observing a location of the distressed ship on the ECDIS device by providing the ECDIS device with a Direction finder of Very High Frequency/Medium Frequency/High Frequency (VHF/MF/HF frequencies).

According to one embodiment, the method for automatic distress alerting further comprises attaching a water sensor based watch to a person working at a sea thereby enabling the person working at sea to send a distress alert manually when the water sensor based watch senses the water and wherein the distress alert is sent to a navigation device on the ship and is delivered to the processor device.

According to one embodiment, the method for automatic distress alerting further comprises connecting the processor device to the ECDIS device on the ship to observe a situation of a distressed person in the water on an electronic map of the ECDIS device of the ship.

According to one embodiment, the method for automatic distress alerting further comprises transmitting a distress alert package directly to one or more satellites in the highest orbit of an earth through an Emergency Position-Indicating Radio Beacon (EPRIB) device, when the ship is sunk.

According to one embodiment, the EPIRB device is released from a package when the ship is sunk and wherein the EPIRB device comes to a water surface automatically after going under the water and the pressure on the EPIRB device is increased.

According to an embodiment herein a system for sending an automatic distress alert message at sea comprising a plurality of sensors mounted on a ship wherein the plurality of sensors include a fire detection sensor and a heat sensor for detecting a fire and a smoke sensor for detecting a smoke in the ship, a flooding detection sensor for sensing floods, a collision and grounding sensor for sensing a collision or an accident of the ship, a man over board sensor for sensing a man over board condition, a sinking vessels sensor with an emergency position-indicating radio beacon (EPIRB), a global positioning system (GPS) for providing a location and a time information in all weather condition and an automatic identification system (AIS). The (AIS) is an automated tracking system used on ships and by vessel traffic services (VTS) for identifying and locating vessels by electronically exchanging data with other nearby ships and VTS stations.

The system for sending an automatic distress alert message at sea further comprises an information processing device comprising a power supply unit, an analog to digital converter for converting analog input to digital data for processing and a main information processing device. The automatic distress alert message system further comprises a digital selective calling (DSC)-VHF/MF/HF DSC device to initiate a ship-to-ship, a ship-to-shore and a shore-to-ship radio telephone and MF/HF radio telex calls, an electronic chart display and information system (ECDIS) for displaying the information from electronic navigational charts (ENC) and integrating position information from the global positioning system (GPS) and a plurality of navigational sensors and the plurality of navigational sensors include Radar and automatic identification systems (AIS), a direction finder with HF/MF/VHF frequency for establishing the direction from which a received signal was transmitted, an emergency position-indicating radio beacon (EPIRB), and wherein the emergency position-indicating radio beacon (EPIRB) is a tracking transmitter for detecting and locating boats, aircraft and people in distress and a SAR Beacon (search and rescue beacon) to detect and locate mariners, aviators and recreational enthusiasts in distress at anywhere in the world at anytime and in almost any condition.

According to one embodiment, the automatic identification system provides an information, and wherein the information include an unique identification, a position, a course, and a speed of a nearby ship and wherein the information is displayed on a screen on an automatic distress alert system in an ECDIS equipped in a ship.

According to one embodiment, each digital selective calling equipped ship is assigned with a unique 9-digit maritime mobile service identity to make a digital selective call to individual stations, groups of stations and to all stations within in a radio range.

According to one embodiment, the system further includes High/Very high/Medium Frequency (HF/VHF/MF) radiotelephone and radio telex (narrow-band direct printing) equipment in HF Frequency, for initiating calls using a digital selective calling (DSC).

According to one embodiment, the ECDIS further displays additional navigation-related information and wherein the additional navigation-related information includes sailing directions and fathometer.

According to one embodiment, the ECDIS is an electronic chart data. The electronic chart data further comprises a vector charts with standardized content, structure and format, issued for use with ECDIS on the authority of government authorized hydrographic offices and a raster charts, and wherein which raster charts are raster navigational charts produced by converting paper charts to digital image by scanner.

According to one embodiment, the direction finder further includes a radio direction finding and wherein the direction finder works by comparing the signal strength of a directional antenna pointing in different directions.

BRIEF DESCRIPTION OF THE DRAWINGS

The other objects, features and advantages will occur to those skilled in the art from the following description of the preferred embodiment and the accompanying drawings in which.

Figure 1:
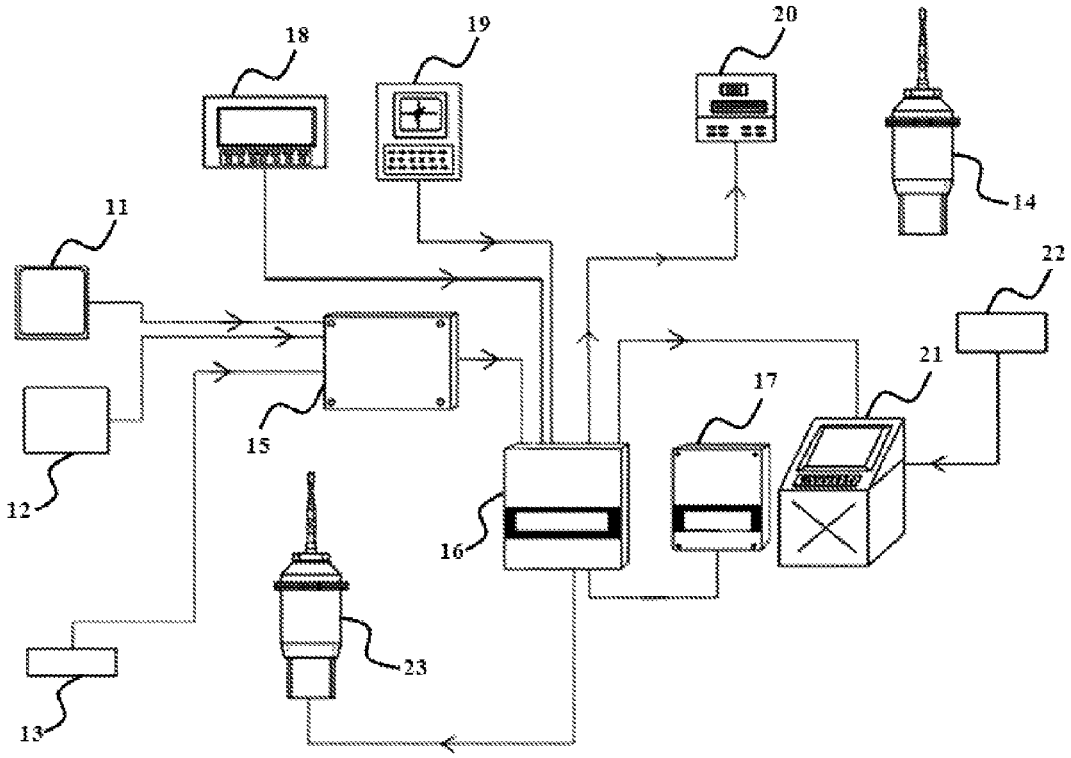
FIG. 1 illustrates a block diagram of a system for automatic distress alerting at sea, according to one embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE EMBODIMENTS HEREIN

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The various embodiments herein provide a method for automatic distress alerting at sea. The method for automatic distress alerting at sea comprises installing a plurality of sensors and processor device on a ship, detecting a distress situation by the plurality of sensors, sending a distress signal to the processor device, initiating an alarm for a pre-defined time by the processor device, confirming the distress situation detected in the ship by a responsible officer, generating a distress alert package by the processor device, sending the distress alert package to a main transmitter device by the processor device, transmitting the distress alert package to one or more satellites in the highest orbit of an earth by the main transmitter device, transmitting the received distress alert package to a terrestrial stations by one or more satellites, informing nearest maritime search and rescue coordination center by the terrestrial stations after receiving the distress alert package and sending one or more rescue teams to a location based on a data provided in the distress alert package. When the alarm is detected to be false and the responsible officer does not confirm the distress situation, the distress alert is removed from a process and when the responsible officer neither confirms nor denies the distress situation for a pre-determined time, a distress alert process is continued automatically and the processor device confirms the distress situation.

According to one embodiment, the plurality of sensors installed on the ship comprises a plurality of fire detection sensors comprising a plurality of heat sensors, and a plurality of smoke sensors for detecting a fire or a smoke on the ship, at least a flooding detection sensor for detecting floods at the sea, at least a collision and grounding sensor for detecting a collision of the ship, a man over board sensor installed in a special form of a watch to detect a man over board situation and at least a sinking vessels sensor with emergency position-indicating radio beacon (EPIRB) for detecting a sinking event of a ship.

According to one embodiment, the generated distress alert package comprises a type of an emergency situation and an event received from the plurality of sensors installed on the ship, a situation of a distressed craft received from a global positioning system, an emergency declaration time received from the global positioning system, an international maritime organization (IMO) number or unique identification number (CALL SIGN) or maritime mobile service identity (MMSI) received from an automatic identification system, a type of a dangerous cargo received from the automatic identification system and a satellite contact number of the distressed craft from one or more satellites.

According to one embodiment, the distress situation is at least one of an event selected from a group of events comprising a fire on a ship, a flooding condition, a falling event from a ship to a sea, a man over board condition, a ship sinking event, a marine accident condition and an aground condition.

According to one embodiment, the method for automatic distress alerting further comprises, confirming and denying a distress situation by the responsible officer in the ship using a confirm button and a deny button provided in the processor device installed on the ship.

According to one embodiment, the main transmitter device is a Search and Rescue Beacon (SAR Beacon) device and the SAR Beacon device sends the distress alert package on a pre-determined frequency and transmits the distress alert package to Space System for the Search of Vessels in Distress-Search and Rescue Satellite-Aided Tracking (COSPAS-SARSAT satellites) in the highest orbit of the earth.

According to one embodiment, the method for automatic distress alerting further comprises displaying an information from electronic navigational charts (ENC) and an integrated position information from a Global Positioning System (GPS) and a plurality of navigational sensors on an electronic chart display and information system (ECDIS) installed on the ship, and wherein the plurality of navigational sensors include Radar and automatic identification systems (AIS).

According to one embodiment, the method for automatic distress alerting further comprises displaying an alert message transmitted by a transmitter positioned on a distressed craft on an ECDIS map to indicate to the responsible officer that a distress alert package is transmitted from the ship by the transmitter devices.

According to one embodiment, the method for automatic distress alerting further comprises identifying a direction of an alert message transmitted from a distressed ship and observing a location of the distressed ship on the ECDIS device by providing the ECDIS device with a Direction finder of Very High Frequency/Medium Frequency/High Frequency (VHF/MF/HF frequencies).

According to one embodiment, the method for automatic distress alerting further comprises attaching a water sensor based watch to a person working at a sea thereby enabling the person working at sea to send distress alert manually when the water sensor based watch senses the water and wherein the distress alert is sent to a navigation device on the ship and is delivered to the processor device.

According to one embodiment, the method for automatic distress alerting further comprises connecting the processor device to the ECDIS device on the ship to observe a situation of a distressed person in the water on an electronic map of the ECDIS device of the ship.

According to one embodiment, the method for automatic distress alerting further comprises transmitting a distress alert package directly to one or more satellites in the highest orbit of an earth through an Emergency Position-Indicating Radio Beacon (EPRIB) device, when the ship is sunk.

According to one embodiment, the EPIRB device is released from a package when the ship is sunk and wherein the EPIRB device comes to a water surface automatically after going under the water and the pressure on the EPIRB device is increased.

The system for sending an automatic distress alert message at sea comprising a plurality of sensors mounted on a ship wherein the plurality of sensors include a fire detection sensor and a heat sensor for detecting a fire and a smoke sensor for detecting a smoke in the ship, a flooding detection sensor for sensing floods, a collision and grounding sensors for sensing a collision or an accident of the ship, a man over board sensor for sensing a man over board condition, a sinking vessels sensor with an emergency position-indicating radio beacon (EPIRB), a global positioning system (GPS) for providing a location and a time information in all weather condition and an automatic identification system (AIS). The (AIS) is an automated tracking system used on ships and by vessel traffic services (VTS) for identifying and locating vessels by electronically exchanging data with other nearby ships and VTS stations.

The system for sending an automatic distress alert message at sea further comprises an information processing device comprising a power supply unit, an analog to digital converter for converting analog input to digital data for processing and a main information processing device. The automatic distress alert message system further comprises a digital selective calling (DSC)-VHF/MF/HF DSC device to initiate a ship-to-ship, ship-to-shore and shore-to-ship radio telephone and MF/HF radio telex calls, an electronic chart display and information system (ECDIS) for displaying the information from electronic navigational charts (ENC) and integrating position information from the global positioning system (GPS) and a plurality of navigational sensors and the plurality of navigational sensors include Radar and automatic identification system (AIS), a direction finder with HF/MF/VHF frequency for establishing the direction from which a received signal was transmitted, an emergency position-indicating radio beacon (EPIRB), and wherein the emergency position-indicating radio beacon (EPIRB) is a tracking transmitter for detecting and locating boats, aircraft and people in distress and a SAR Beacon (search and rescue beacon) to detect and locate mariners, aviators and recreational enthusiasts in distress at anywhere in the world at anytime and in almost any condition.

According to one embodiment, the automatic identification system provides an information, and wherein the information include an unique identification, a position, a course, and a speed of a nearby ship and wherein the information is displayed on a screen on an automatic distress alert system in an ECDIS equipped in a ship.

According to one embodiment, each digital selective calling equipped ship is assigned with a unique 9-digit maritime mobile service identity to make a digital selective call to individual stations, groups of stations and to all stations within in a radio range.

According to one embodiment, the system further includes High/Very high/Medium Frequency (HF/VHF/MF) radiotelephone and radio telex (narrow-band direct printing) equipment in HF Frequency, for initiating calls using a digital selective calling (DSC).

According to one embodiment, the ECDIS further displays additional navigation-related information and wherein the additional navigation-related information includes sailing directions and fathometer.

According to one embodiment, the ECDIS is an electronic chart data. The electronic chart data further comprises a vector chart with standardized content, structure and format, issued for use with ECDIS on the authority of government authorized hydrographic offices and a raster chart, and wherein the raster charts are raster navigational charts produced by converting paper charts to digital image by scanner.

According to one embodiment, the direction finder further includes a radio direction finding and wherein the direction finder works by comparing the signal strength of a directional antenna pointing in different directions.

FIG. 1 illustrates the system architecture for automatic distress alerting at sea, according to one embodiment herein. The system for sending an automatic distress alert message at sea comprises a plurality of sensors mounted on a ship wherein the plurality of sensors include a fire detection sensor 13 and a heat sensor for detecting a fire and a smoke sensor for detecting a smoke in the ship, a flooding detection sensor 12 for sensing floods, a collision and grounding sensors 11 for sensing a collision or an accident of the ship, a man over board sensor for sensing a man over board condition, a sinking vessels sensor with an emergency position-indicating radio beacon (EPIRB) 14. The system further includes a global positioning system (GPS) 19 for providing a location and time information in all weather condition and an automatic identification system (AIS) 18. The AIS 18 is an automated tracking system used on ships and by vessel traffic services (VTS) for identifying and locating vessels by electronically exchanging data with other nearby ships and VTS stations.

The system for sending an automatic distress alert message at sea further comprises an information processing device 16 comprising a power supply unit 17, an analog to digital converter 15 for converting analog input to digital data for processing and a main information processing device. The automatic distress alert message system further comprises a digital selective calling (DSC)-VHF/MF/HF DSC device 20 to initiate a ship-to-ship, ship-to-shore and shore-to-ship radio telephone and MF/HF radio telex calls, an electronic chart display and information system (ECDIS) 21 for displaying the information from electronic navigational charts (ENC) and integrating position information from the global positioning system (GPS) 19 and a plurality of navigational sensors and the plurality of navigational sensors include Radar and automatic identification systems (AIS) 18. The system further includes a direction finder with HF/MF/VHF frequency 22 for establishing the direction from which a received signal was transmitted, an emergency position-indicating radio beacon (EPIRB) 14, and wherein the emergency position-indicating radio beacon (EPIRB) 14 is a tracking transmitter for detecting and locating boats, aircraft and people in distress and a SAR Beacon (search and rescue beacon) 23 to detect and locate mariners, aviators and recreational enthusiasts in distress at anywhere in the world at anytime and in almost any condition.

Figure 2:
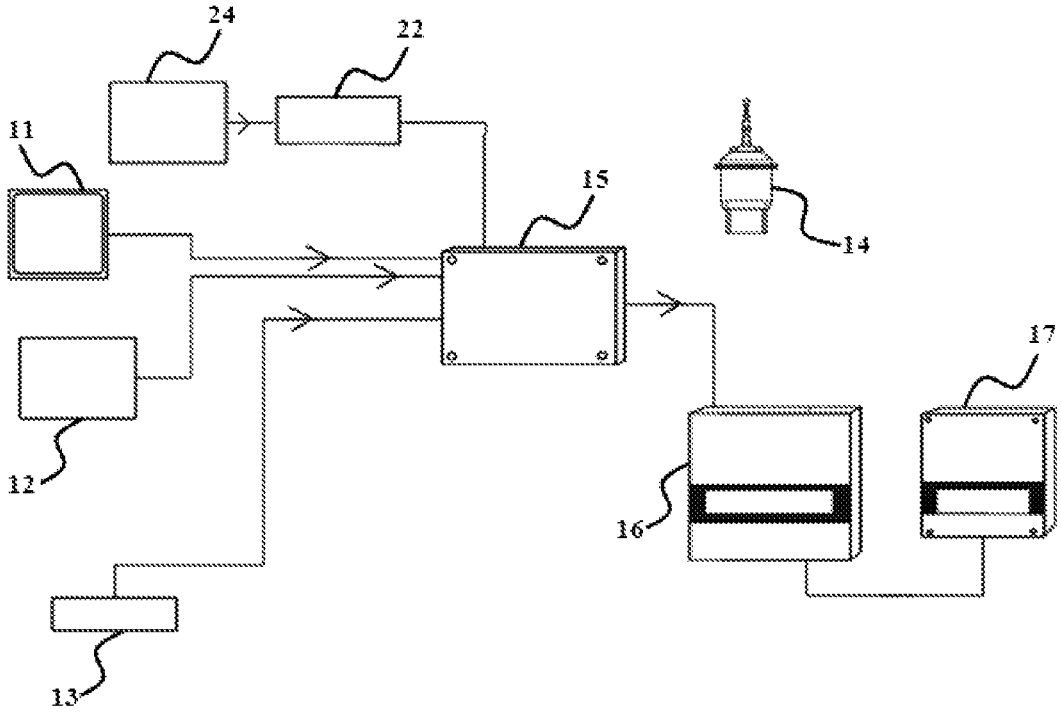
FIG. 2 illustrates a block diagram of a system for messaging automatic alarming during various distress situations, according to one embodiment herein.

FIG. 2 is a block diagram illustrating automatic alarming during various distress situations, according to one embodiment herein. The automatic distress alerting system includes a plurality of sensors to detect distress at sea. Plurality of sensors includes a fire and smoke detection sensor 13 like smoke and heat detection sensors and a flooding detection sensor 12 like water pressure and water level sensors. The system further comprises a collision and aground sensors 11 to detect collision at sea like Index marine, Cruz Pro BWA20, Jabsco Hydro Air Switches, Water Witch, Ormston Technology, Hydralert System and Electronic Devices (ED830). The system also includes EPIRB 14 enclosed in a bracket to detect sinking of ship and automatic man over board sensors 24 to detect man over board. The automatic man over board sensors 24 are installed in special wrist watches like bands and are attached to the man in the ship so that the watch will manually or automatically send the distress alert on 121/5 frequency as it connects with water, so this frequency will be received by the navigation device on the ship and will be delivered to the information processing device 16 comprising a power supply unit 17 and an analog to digital converter 15. As the information processing device 16 is connected to the ECDIS device on the ship, the situation of the distressed person in the water can easily be observed on the electronic map of ECDIS device of the ship.

If the ship is sunk, EPIRB device 14 is released from a bracket and the EPIRB device 14 comes to the water surface automatically after going under the water and the pressure increase on it, and then it will send the distress alert.

The intended sensors detect the distress event as it occurs and passes the data to the information processing device 16 through the analog to digital converter 15. Analog to digital converter 15 is used to make data sent from the sensors readable to the information processing device 16. The information processing device 16 comprises a power supply unit 17 to supply power. At this time the alarm is activated in the ship to inform the distress situation. The alarm is activated for a pre-determined period of time (like 5 minutes). The responsible officer in the ship confirms the distress situation by pressing confirm button provided on the information processing device 16. If the distress alarm is false then the responsible officer in the ship denies the distress situation by pressing a deny button provided on the information processing device 16. If the responsible officer neither confirms nor denies the distress situation over a period of time then the information processing device 16 confirms the distress situation by itself.

Figure 3:
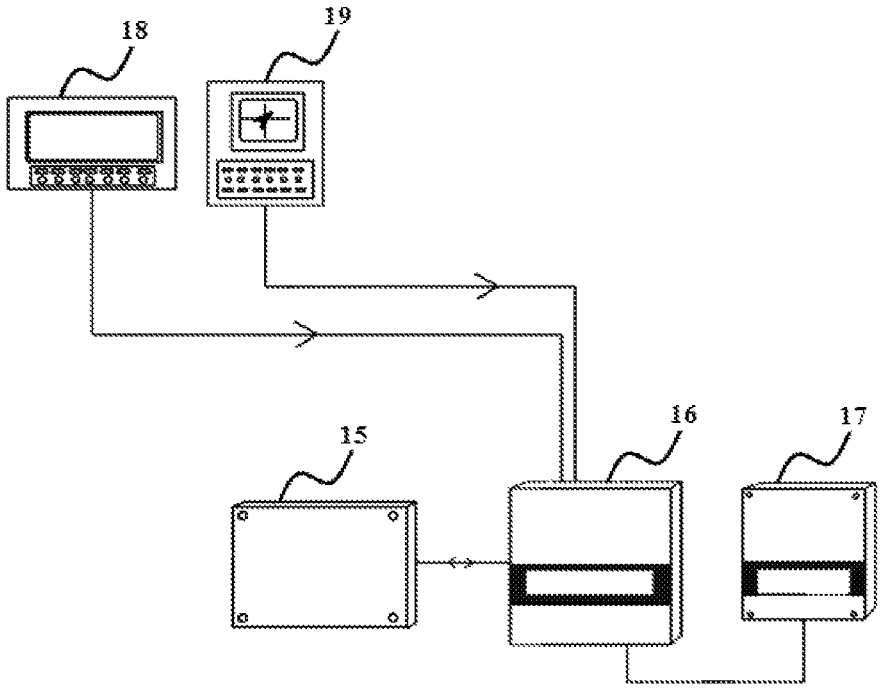
FIG. 3 illustrates a block diagram of an Automatic Identification System (AIS) installed in the ship and Global Positioning System (GPS) in a system for automatic distress alert messaging system according to one embodiment herein.

FIG. 3 is a block diagram illustrating the Automatic Identification System (AIS) installed in the ship and Global Positioning System (GPS), according to one embodiment herein. The automatic distress alerting also includes Automatic Identification System (AIS) 18 which is installed in the ship. The Automatic Identification System (AIS) 18 is an automated tracking system used on ships and by Vessel Traffic Services (VTS) for identifying and locating vessels by electronically exchanging data with other nearby ships and VTS stations. AIS 18 information supplements marine Radar, which continues to be the primary method of collision avoidance for water transport. A marine traffic coordinator manages vessel traffic using AIS 18 and Radar. An AIS 18 equipped system on board a ship presents the bearing and a distance of nearby vessels in a Radar-like display format. A graphical display of AIS data on board a ship including an information provided by AIS equipment 18, such as unique identification, position, course, and speed, is displayed on a screen or an ECDIS. The information from the AIS 18 is shared with the information processing device 16 comprising a power supply unit 17 and an analog to digital converter 15. AIS 18 is intended to assist a vessel's watch standing officers and allow maritime authorities to track and monitor vessel movements. AIS 18 integrates a standardized VHF transceiver with a positioning system such as a LORAN-C or GPS 19 receiver, with other electronic navigation sensors, such as a gyrocompass or rate of turn indicator. Ships outside AIS 18 radio range can be tracked with the Long Range Identification and Tracking (LRIT) system with less frequent transmission.

The automatic distress alerting system further includes the Global Positioning System (GPS) 19. The Global Positioning System (GPS) 19 is a space-based global navigation satellite system (GNSS) that provides location and time information in all weather, anywhere on or near the Earth, where there is an unobstructed line of sight to four or more GPS satellites. The information from the GPS 19 is fed to the information processing device 16 in the ship.

After the responsible officer confirms the distress alert, the plurality of sensors identifies the type of distress alert received in the information processing device 16. The distress alert package is generated with the type of distress alert received. For computing this package, the information processing device 16 receives some of the data through GPS 19 and AIS 18 devices. The information processing device 16 receives data like the situation of the distressed craft and emergency declaration time from the GPS 18 and IMO number, CALL SIGN or MMSI number and type of dangerous cargo from the AIS 19.

A satellite contact number of the ship is also entered in the distress package. The distress package includes the following data in order: the type of the emergency situation and event, the situation of the distressed craft, emergency declaration time, IMO number or CALL SIGN or MMSI, type of dangerous cargo and satellite contact number of the distressed craft. After completing the distress package the information processing device 16 sends the distress package to the main transmitter device.

Figure 4:
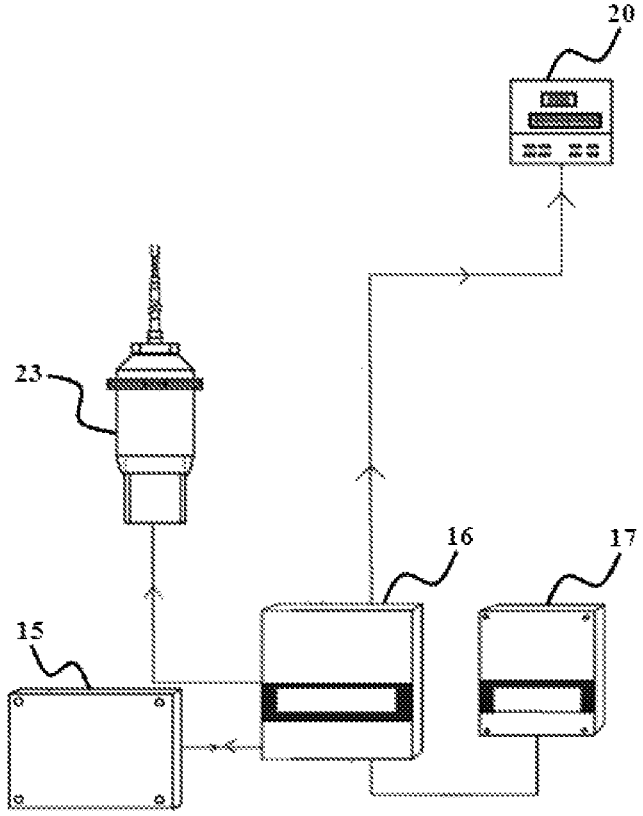
FIG. 4 illustrates a block diagram of a system for Search and Rescue Beacon (SAR Beacon and Digital Selective Calling on Very High/High/Medium Frequencies (DSC VHF/HF/MF in a system for automatic distress alert messaging system), according to one embodiment herein.

FIG. 4 is a block diagram illustrating Search and Rescue Beacon (SAR Beacon and Digital Selective Calling on Very High/High/Medium Frequencies (DSC VHF/HF/MF), according to one embodiment herein. The automatic distress alerting system includes a Search and Rescue Beacon (SAR Beacon) 23. The SAR Beacon 23 is a main transmitter device for sending the data. SAR Beacon device 23 sends the data on the frequency of 406 MHz and transmits this data to the satellites COSPAS-SARSAT in the highest orbit of the earth, and then the satellites in turn transmit all the received distress data to the terrestrial stations. The terrestrial stations inform the nearest Maritime Search and Rescue Coordination Center immediately after receiving the distress alert. Furthermore, the data package of the distress data is transmitted to the VHF/MF/HF DSC devices 20 through the information processing device 16, and consequently the distress alert (data package) is transmitted to these devices through the radio waves. The existence of one of the VHF/MF/HF DSC devices 20 depends on the travel range of the ship. After transmitting the data package by the transmitter bases, the information processing device 16 transmits the information related to the delivery of distress alert package to ECDIS device 23 to avoid the responsible officer from being bewildered or shocked and also to make the operation of the system simpler.

The DSC 20 is primarily intended to initiate ship-to-ship, ship-to-shore and shore-to-ship radio telephone and MF/HF radio telex calls. DSC calls are also be made to individual stations, groups of stations, or "all stations" in one's radio range. Each DSC-equipped ship, shore station and group is assigned a unique 9-digit Maritime Mobile Service Identity. DSC distress alerts, which consist of a preformatted distress message, are used to initiate emergency communications with ships and rescue coordination centers. DSC 20 eliminates the need for persons on a ship's bridge or on shore to continuously guard radio receivers on voice radio channels, including VHF channel 16 (156.8 MHz) and 2182 kHz now used for distress, safety and calling. The automatic distress alerting system also includes High/Very high/Medium Frequency (HF/VHF/MF) 20 radio telephone and radio telex (narrow-band direct printing) equipment in HF Frequency, with calls initiated by digital selective calling (DSC) 20. Worldwide broadcasts of maritime safety information is also done on HF narrow-band direct printing channels.

Figure 5:
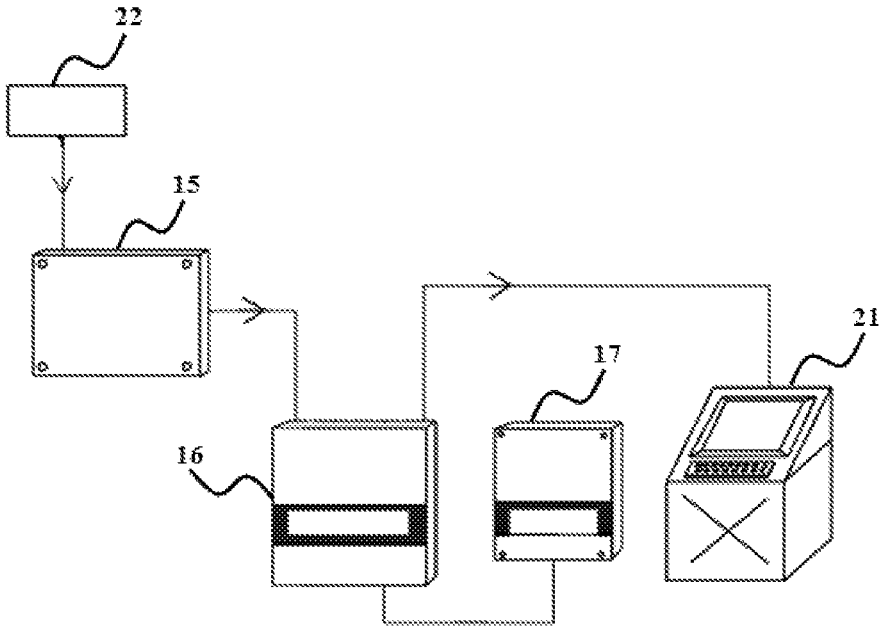
FIG. 5 illustrates a block diagram of a Direction Finder (DF) and the Electronic Chart Display and Information System (ECDIS) in a system for automatic distress alert messaging system installed in the ship, according to one embodiment herein.

FIG. 5 is a block diagram illustrating the Direction Finder (DF) and the Electronic Chart Display and Information System (ECDIS) installed in the ship, according to one embodiment herein. The automatic distress alerting system includes an Electronic Chart Display and Information System (ECDIS) 21. The ECDIS 21 is a computer-based navigation information system that complies with International Maritime Organization (IMO) regulations and used as an alternative to paper nautical charts. IMO refers to similar systems not meeting the regulations as Electronic Chart Systems (ECS). An ECDIS system 21 displays the information from electronic navigational charts (ENC) and integrates position information from the Global Positioning System (GPS) and other navigational sensors, such as Radar and automatic identification systems (AIS). It also displays additional navigation-related information, such as Sailing Directions and fathometer.

The ECDIS system 21 includes Electronic chart data. The electronic chart data includes the vector charts and the raster charts. The vector charts are the chart databases for ECDIS 21, with standardized content, structure and format, issued for use with ECDIS 21 on the authority of government authorized hydrographic offices. ENCs are vector charts that also conform to International Hydrographic Organization (IHO) specifications.

ENCs contain all the chart information necessary for safe navigation, and contain supplementary information in addition to that contained in the paper chart (e.g., Sailing Directions). This supplementary information is considered necessary for safe navigation and is displayed together as a seamless chart. ENCs are intelligent, in that systems using them are programmed to give warning of impending danger in relation to the vessel's position and movement.

Raster navigational charts are raster charts that conform to IHO specifications and are produced by converting paper charts to digital image by scanner. The image is similar to digital camera pictures, which are zoomed in for more detailed information as it does in ENCs.

After the transmission of the data package by the transmitter bases the information processing device 16 transmits the information related to the delivery of distress alert package to ECDIS device 21. The alert message and the transmitter bases on the distressed craft are displayed on the ECDIS 21 map. This indicates that a distress alert package has been transmitted from the above ship with the mentioned data by the transmitter devices so that the responsible officer is easily informed of what happens when there is no need to leave the ship and manage the calamity. Since the ECDIS device 21 is equipped with DF or Direction finder 22 of VHF/MF/HF frequencies and 406 MHz, the other ships on which the distress alert automatic system is installed identify the direction of the alert transmitted from the distressed ship and observe it on their ECDIS devices 21.

And also considering the fact that the abovementioned devices connected to AIS device through the processor device, the location of the distressed ship is simply displayed on the ECDIS 22 monitors of all the other crafts, as well as coastal stations, so that these crafts can relieve the distressed vessel.

Advantage of this system is completely automatic distress alerting at sea and human being just has a supervisory role over the proper function of the system. Other advantages includes after the distress data package was sent, all of the devices used in the process of distress alert transmission can be observed on the ECDIS device's monitor. The human being has to confirm the detected calamity as the supervisor, and if the distress is confirmed by the human being, all the other procedures are going to be implemented automatically. If the alarm is false and officer does not confirm that, this distress alert will be removed from the process and if the responsible officer neither confirms nor denies the event in a pre-determined time, the process will continue automatically and will be considered as distress.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

What is claimed is:

1. A method for automatic distress alerting at sea, the method comprises:

installing a plurality of sensors on a ship;

installing a processor device on the ship;

detecting a distress situation by the plurality of sensors;

sending a distress signal to the processor device;

initiating an alarm for a pre-defined time by the processor device;

confirming the distress situation detected in the ship by a responsible officer;

generating a distress alert package by the processor device, and wherein the generated distress alert package comprises a type of the emergency situation and an event received from the plurality of sensors installed on the ship, a situation of a distressed craft received from a global positioning system, an emergency declaration time received from the global positioning system, an international maritime organization (IMO) number or unique identification number (CALL SIGN) or maritime mobile service identity (MMSI) received from an automatic identification system, a type of a dangerous cargo received from the automatic identification system, and a satellite contact number of the distressed craft from one or more satellites;

sending the distress alert package to a main transmitter device by the processor device;

transmitting the distress alert package to one or more satellites in the highest orbit of an earth by the main transmitter device;

transmitting the distress alert package directly to one or more satellites in the highest orbit of an earth through an Emergency Position-Indicating Radio Beacon (EPRIB) device, when the ship is sunk, and wherein the EPIRB device is released from a package when the ship is sunk and wherein the EPIRB device comes to a water surface automatically after going under the water and the pressure on the EPIRB device is increased;

transmitting the received distress alert package to a plurality of terrestrial stations by one or more satellites;

informing a nearest maritime search and rescue coordination center by the plurality of terrestrial stations after receiving the distress alert package; and sending one or more rescue teams to a location based on a data provided in the distress alert package, displaying an information from electronic navigational charts (ENC) and an integrated position information from a Global Positioning System (GPS) and a plurality of navigational sensors, on an electronic chart display and information system (ECDIS) installed on the ship, and wherein the plurality of navigational sensors include Radar and automatic identification systems (AIS);

displaying an alert message transmitted by a transmitter positioned on a distressed craft on an ECDIS map to indicate to the responsible officer that a distress alert package is transmitted from the ship by the transmitter devices, and wherein the ECDIS IS an electronic chart data comprising a plurality of vector charts with standardized content, structure and format, issued for use with ECDIS on the authority of government authorized hydrographic offices, and a plurality of raster charts, and wherein the plurality of raster charts are raster navigational charts produced by converting paper charts to digital image by a scanner;

identifying a direction of an alert message transmitted from a distressed ship and observing a location of the distressed ship on the ECDIS device by providing the ECDIS device with a Direction finder of Very High Frequency/Medium Frequency/High Frequency (VHF/MF/HF frequencies), and wherein the direction finder further includes a radio direction finding and wherein the direction finder works by comparing the signal strength of a directional antenna pointing in different directions, and wherein the ECDIS further displays additional navigation-related information and wherein the additional navigation-related information includes sailing directions and a Fathometer reading;

wherein the distress alert is removed from a transmission process when the alarm is detected to be false and the responsible officer does not confirm the distress situation and wherein a distress alert process is continued automatically and the processor device confirms the distress situation when the responsible officer neither confirms nor denies the distress situation for a pre-determined time.

2. The method according to claim 1, wherein the plurality of sensors installed on the ship comprises:

a plurality of fire detection sensors comprising a plurality of heat sensors;

a plurality of smoke sensors for detecting fire or smoke on the ship;

at least a flooding detection sensor for detecting floods at the sea;

at least a collision and grounding sensor for detecting a collision of the ship;

a man over board sensors installed in a special form of a watch to detect a man over board situation; and at least a sinking vessels sensor with emergency position-indicating radio beacon (EPIRB) for detecting a sinking event of a ship.

3. The method according to claim 1, wherein the distress situation is at least one of an event selected from a group of events comprising a fire on a ship, a flooding condition, a falling event from a ship to a sea, a man over board condition, a ship sinking event, a marine accident condition and an aground condition.

4. The method according to claim 1, further comprises confirming and denying a distress situation by the responsible officer in the ship using a confirm button and a deny button provided in the processor device installed on the ship.

5. The method according to claim 1, wherein the main transmitter device is a Search and Rescue Beacon (SAR Beacon) device and wherein the SAR Beacon device sends the distress alert package on a pre-determined frequency and transmits the distress alert package to a Space System for the Search of Vessels in Distress-Search and Rescue Satellite-Aided Tracking (COSPAS-SARSAT) satellites in the highest orbit of the earth.

6. The method according to claim 1, further comprises attaching a water sensor based watch to a person working at a sea thereby enabling the person working at sea to send distress alert manually when the water sensor based watch senses the water and wherein the distress alert is sent to a navigation device on the ship and is delivered to the processor device.

7. The method according to claim 1, further comprises connecting the processor device to the ECDIS device on the ship to observe a situation of a distressed person in the water on an electronic map of the ECDIS device of the ship.

8. A system for sending an automatic distress alert message at sea, the system comprising:

a plurality of sensors mounted on a ship wherein the plurality of sensors include at least a fire detection sensor and at least a heat sensor for detecting a fire and at least a smoke sensor for detecting a smoke in the ship;

at least a flooding detection sensor for sensing floods;

at least a collision and grounding sensor for sensing a collision or an accident of the ship;

a man over board sensor for sensing a man over board condition;

at least a sinking vessel sensor with an emergency position-indicating radio beacon (EPIRB);

a global positioning system (GPS) for providing a location and time information in all weather condition;

an automatic identification system (AIS), and wherein the automatic identification system (AIS) is an automated tracking system used on ships and by vessel traffic services (VTS) for identifying and locating vessels by electronically exchanging data with other nearby ships and VTS stations;

an information processing device, and wherein the information processing device comprises a power supply unit, an analog to digital converter for converting analog input to digital data for processing, and a main information processing device;

a digital selective calling (DSC)-VHF/MF/HF DSC device to initiate a ship to-ship, a ship-to-shore and a shore-to-ship radio telephone and MF/HF radio telex calls;

a High/Very high/Medium Frequency (HFNHF/MF) radiotelephone and a radio telex (narrow-band direct printing) equipment in HF Frequency, for initiating calls using a digital selective calling (DSC);

an electronic chart display and information system (ECDIS) for displaying an information from electronic navigational charts (ENC) and integrating a position information from the global positioning system (GPS) and a plurality of navigational sensors, and wherein the plurality of navigational sensors include Radar and automatic identification systems (AIS), and wherein the ECDIS further displays additional navigation-related information and wherein the additional navigation-related information includes sailing directions and a Fathometer reading, and wherein the ECDIS IS an electronic chart data comprises a plurality of vector charts with standardized content, structure and format, issued for use with ECDIS on the authority of government authorized hydrographic offices, and a plurality of raster charts, and wherein the plurality of raster charts are raster navigational charts produced by converting paper charts to digital image by scanner;

a direction finder operating in HF/MF/VHF frequency for establishing the direction from which a received signal was transmitted, and wherein the direction finder further includes a radio direction finding and wherein the direction finder works by comparing the signal strength of a directional antenna pointing in different directions;

an emergency position-indicating radio beacon (EPIRB), and wherein the emergency position-indicating radio beacon (EPIRB) is a tracking transmitter for detecting and locating boats, aircraft and people in distress; and a SAR Beacon (search and rescue beacon) to detect and locate mariners, aviators, and recreational enthusiasts in distress at anywhere in the world at anytime and in almost any condition.

9. The system of claim 8, wherein the automatic identification system provides an information, and wherein the information include an unique identification, a position, a course, and a speed of a nearby ship and wherein the information is displayed on a screen on an automatic distress alert system in an ECDIS equipped in a ship.

10. The system of claim 8, wherein each digital selective calling equipped ship is assigned with a unique 9-digit maritime mobile service identity to make a digital selective call to individual stations, groups of stations and to all stations within in a radio range.

* * * * *